US005479861A

United States Patent [19]

Kinchin

[11] Patent Number: 5,479,861

[45] Date of Patent: Jan. 2, 1996

[54] PROJECTILE WITH SABOT

[76] Inventor: Anthony E. Kinchin, No. 12 Slaney Rd., Walsall, West Midlands, United Kingdom, WS2 9AF

[21] Appl. No.: 176,936

[22] Filed: Jan. 3, 1994

[51] Int. Cl.[6] ..... F42B 14/06

[52] U.S. Cl. ..... 102/439; 102/517; 102/520

[58] Field of Search ..... 102/430, 439, 102/448, 449, 450, 451, 452, 453, 461, 501, 503, 507–509, 514–523, 532; 244/3.23

[56] References Cited

U.S. PATENT DOCUMENTS

| | | | |
|---|---|---|---|
| 36,773 | 10/1862 | Emery | 102/523 |
| 620,400 | 2/1899 | Ahrens | 102/522 |
| 1,794,141 | 2/1931 | Bloch-Jorgensen . | |
| 2,996,011 | 8/1961 | Dunlap | 102/93 |
| 3,398,682 | 8/1968 | Abela | 102/439 |
| 3,613,584 | 10/1971 | Hendricks | 102/38 |
| 3,650,213 | 3/1972 | Abbott et al. | 102/38 |
| 3,695,181 | 10/1972 | Bull et al. | 102/93 |
| 3,713,388 | 1/1973 | Pontoriero | 102/38 |
| 3,726,231 | 4/1973 | Kelly et al. | 102/93 |
| 3,795,196 | 3/1974 | Hillenbrand | 102/517 |
| 4,043,267 | 8/1977 | Hayashi | 102/439 |
| 4,155,308 | 5/1979 | Murawski | 102/522 |
| 4,164,903 | 8/1979 | Bouza | 102/532 |
| 4,175,493 | 11/1979 | Daily | 102/522 |
| 4,301,733 | 11/1981 | Arciniega Blanco | 102/513 |
| 4,384,529 | 5/1983 | Burns et al. | 102/525 |
| 4,413,564 | 11/1983 | Brown | 102/501 |
| 4,413,565 | 11/1983 | Mattey et al. | 102/503 |
| 4,467,724 | 8/1984 | Marlow | 102/520 |
| 4,471,699 | 9/1984 | Turco et al. | 102/501 |
| 4,505,204 | 3/1985 | Wilkstrom | 102/523 |
| 4,587,905 | 5/1986 | Maki | 102/430 |
| 4,644,866 | 2/1987 | Sullivan | 102/439 |
| 4,669,385 | 6/1987 | Maki | 102/532 |
| 4,676,169 | 6/1987 | Maki | 102/439 |
| 4,700,630 | 10/1987 | Sullivan | 102/439 |
| 4,768,441 | 9/1988 | Theis | 102/517 |
| 4,773,331 | 9/1988 | Rossman | 102/520 |
| 4,829,904 | 5/1989 | Sullivan | 102/439 |
| 5,012,744 | 5/1991 | Sowash | 102/523 |
| 5,016,538 | 5/1991 | Sowash | 102/520 |
| 5,069,139 | 12/1991 | Denis | 102/518 |
| 5,103,736 | 4/1992 | Sowash | 102/523 |
| 5,138,951 | 8/1992 | Berville et al. | 102/521 |
| 5,164,539 | 11/1992 | French | 102/520 |
| 5,175,389 | 12/1992 | Kramer et al. | 102/521 |
| 5,175,394 | 12/1992 | Sowash | 102/522 |
| 5,235,915 | 8/1993 | Stevens | 102/439 |
| 5,239,928 | 8/1993 | Ricci | 102/439 |
| 5,339,743 | 8/1994 | Scarlata | 102/439 |
| 5,361,701 | 11/1994 | Stevens | 102/450 |

FOREIGN PATENT DOCUMENTS

| | | | |
|---|---|---|---|
| 1016766 | 11/1952 | France | 102/520 |
| 026717 | 5/1956 | Germany | 102/501 |
| 2444181 | 4/1976 | Germany | 102/439 |
| 1291132 | 9/1972 | United Kingdom | 102/532 |

*Primary Examiner*—Harold J. Tudor
*Attorney, Agent, or Firm*—Webb Ziesenheim Bruening Logsdon Orkin & Hanson

[57] ABSTRACT

A projectile having a cylindrical slug with a forward end portion and a rear end portion having substantially the same outer diameter. A sabot surrounds the slug and is nonrotatably connected to the slug so that the rotary motion which is imparted to the sabot by contact between the external surface of the sabot and rifling in a gun barrel is transferred directly to the slug by the nonrotatable connection between the sabot and the slug.

22 Claims, 3 Drawing Sheets

PROJECTILE WITH SABOT

BACKGROUND OF THE INVENTION

1. Field of the Invention

The invention is directed generally to an improved projectile including a sabot and a trailing wad and, more particularly, to an improved projectile wherein the sabot is nonrotatably connected to the slug so that the sabot and the slug are rotating at substantially the same rate as the projectile travels along a rifled gun barrel.

2. Description of Prior Art

Projectiles having a sabot are known for use in shotgun barrels and other gun barrels. It is desirable that the sabot rotates as the projectile travels along the length of a rifled gun barrel in order to impart rotation to the projectile which assists in guiding the projectile to the target when the projectile exits the gun barrel.

When a projectile including a sabot travels along a rifled gun barrel, the sabot expands due to heat and pressure and the outer surface is forced into contact with rifling in the gun barrel which imparts a rotary motion to the sabot. The rotation of the sabot imparts a certain amount of rotary motion to the slug.

It is known that an increase in the weight of a slug will increase the penetration of the slug on impact, but an increase in the weight of a slug generally interferes with the trajectory because the heavier slug tends to fall off a target in a relatively shorter distance. The addition of a trailing wad to a slug improves the trajectory at distances up to approximately 150 yards. Thus, a trailing wad will increase the stability of a slug when discharged from both smooth bore and rifled gun barrels.

SUMMARY OF THE INVENTION

A projectile according to the invention includes a lead slug and a sabot surrounding and nonrotatably connected to the exterior of the slug. Additionally, the projectile includes a wad having a post fitted into an axial blind bore in the slug and a trailing portion located externally of the rear of the slug. The wad post is inserted into the axial bore in the slug during the assembly of the projectile and an annular groove is formed in the wad post immediately adjacent to the trailing portion of the wad at the rear end of the slug. When the charge in the shell casing is detonated, the physical forces distort a portion of the lead at the rear of the slug. An annular bead of lead is forced into the annular groove in the wad post, and this annular lead bead serves to firmly lock the wad onto the slug during flight.

In a first embodiment of the invention, the projectile includes a sabot having two arcuate segments which surround and are nonrotatably connected to a slug by two pairs of radial outwardly extending lugs which are located on the forward and rear end portions of the slug. The lugs in each pair are radially spaced 180° from each other around the slug and all four lugs are located in the same longitudinal plane. In an alternative embodiment of the invention, the arcuate segments of the sabot are nonrotatably connected to a lead slug by serrations on the inner surface of each sabot segment which contact the external surfaces of the forward and rear end portions of the slug. In another embodiment of the invention, a radial inwardly extending protrusion on the inner surface of each arcuate sabot segment extends into a blind radial hole formed in the slug. If desired, the protrusions may be split on the facing edges of the segments. The blind holes are radially spaced 180° from each other around the slug. In a further embodiment of the invention, a longitudinal radial inwardly extending tongue extends along the inner surface of each arcuate sabot segment. Each tongue fits into corresponding radial grooves formed in the forward and rear end portions of the slug. In an additional embodiment of the invention, the sabot is formed by a pair of arcuate segments having an inwardly directed convex central neck which extends into a complementary concave waist formed on the exterior of the intermediate portion of the slug. Each sabot segment has a projection on one longitudinal edge and a radial bore on the opposed longitudinal edge. The projection on one segment extends into the bore on the other segment to connect the segments with the convex neck formed by the segments extending into the concave waist formed on the slug.

Longitudinal grooves extending along the length of a slug are not practical because of the radially decreased waist in the intermediate portion of the slug. The radially decreased waist is important to improve the aerodynamic flight of the slug. Additionally, the inclusion of the radially decreased waist on the slug of the invention permits the slug to substantially expand upon impact.

Regardless of the type of connection between the slug and the sabot segments, the projectile includes a wad with an axial wad post fixed in a blind longitudinal axial bore formed in the lead slug and a rear trailing portion which extends behind the rear end of the lead slug. An annular groove is formed in the wad at the juncture of the post and the trailing portion. This annular groove is located adjacent to the rear end of the slug when the slug and the wad are assembled. The annular groove receives an annular bead of lead from the slug when the powder charge in the shell is detonated because the physical forces created by the detonation force lead from the rear end of the slug into the annular groove in the wad. The bead of lead in the annular groove tightly connects the wad to the slug during flight and an accurate shot results along with a lower trajectory of the slug.

A complete understanding of the invention will be obtained from the following description when taken in connection with the accompanying figures of drawings wherein the like reference numerals identify like parts throughout.

DESCRIPTION OF THE PREFERRED EMBODIMENTS

Figure 1:
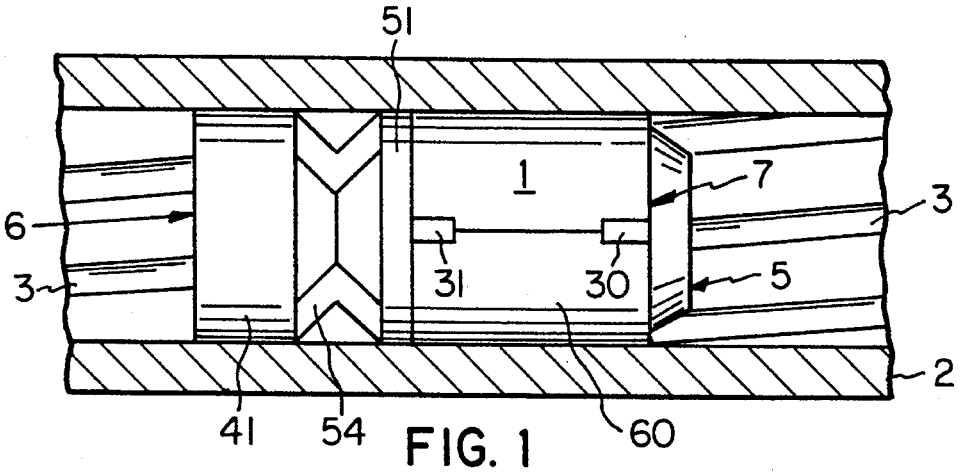
FIG. 1 is a plan view of a projectile according to the invention in a rifled gun barrel after discharge from a shell casing.
Figure 2:
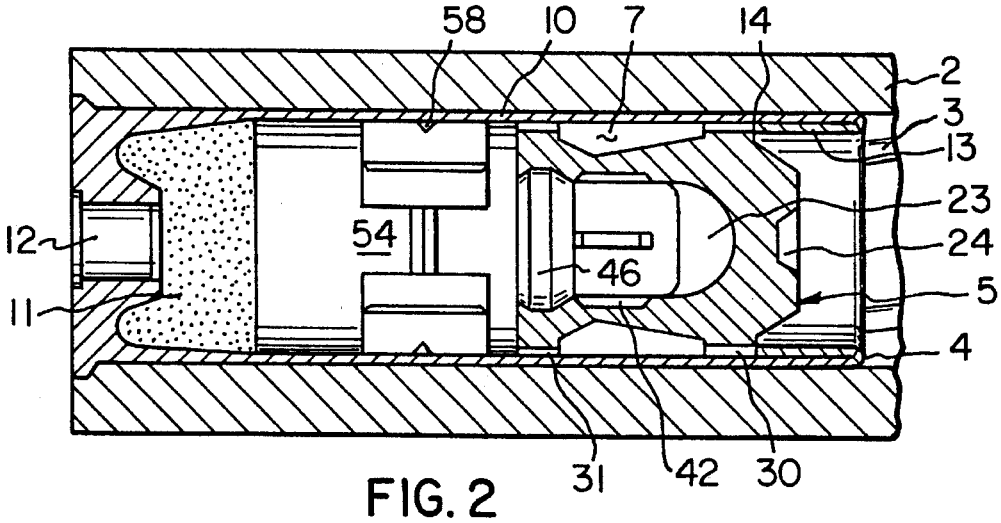
FIG. 2 is a longitudinal vertical section on the center line of a projectile according to the invention in a shell casing prior to detonation.
Figure 3:
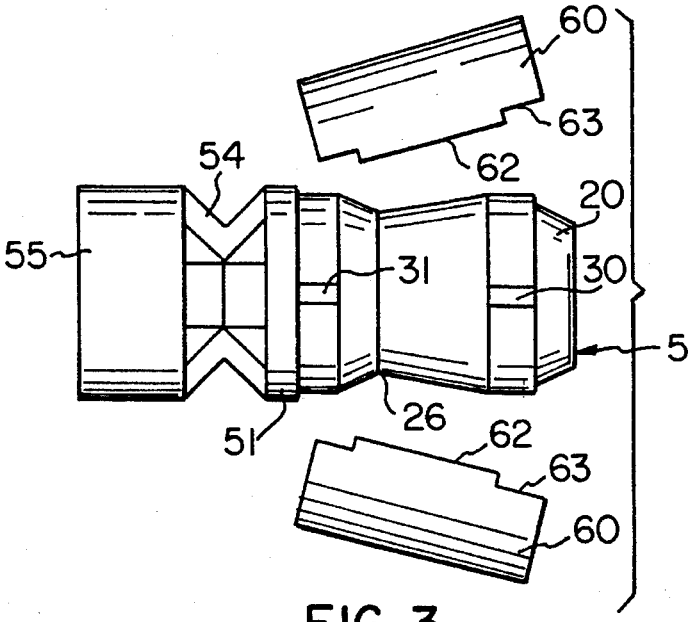
FIG. 3 is an exploded view of a projectile with the sabot segments separating from a slug after discharge from a gun barrel.
Figure 4:
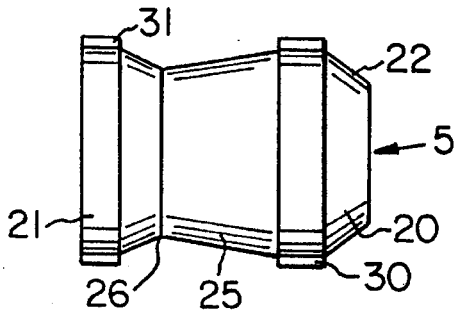
FIG. 4 is an elevation of a slug according to the invention.
Figure 5:
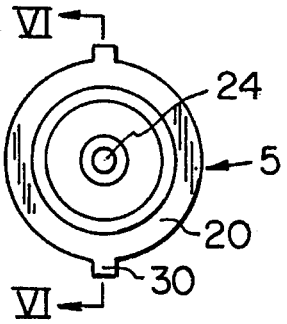
FIG. 5 is a front end view of the slug shown in FIG. 4.
Figure 6:
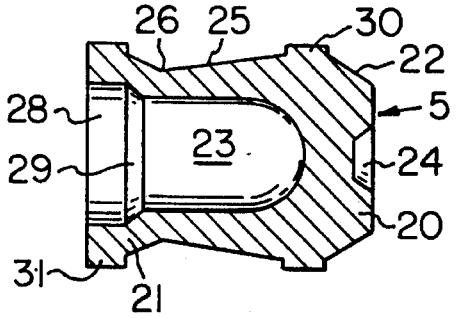
FIG. 6 is a longitudinal section on line VI—VI of FIG. 5.

FIG. 1 of the drawings shows a projectile generally designated 1 in a gun barrel 2 which has rifling 3. The projectile includes a lead slug 5, a wad 6 and a sabot 7 surrounding the exterior of the slug. As shown in FIG. 2 of the drawings, the projectile is placed within a shell casing 10 which has a powder charge 11 at the closed end. A detonator 12 is positioned in the closed end of the shell casing in contact with powder charge 11 so that contact with the detonator causes the powder charge to ignite and force projectile 1 out of the shell casing along gun barrel 2. The open end of shell casing 10 is crimped inwardly upon itself as shown at 4 to provide an annular inner portion 13 having an annular lip 14 in contact with the forward edges of the sabot segments to hold the projectile in the shell casing prior to ignition of powder charge 11.

The shell casing is placed in a gun barrel 2 which has the rifling 3 to impart a rotary motion to the projectile as it passes along the length of the gun barrel to the discharge end. The rotary motion is imparted to the projectile because the exterior surface of the projectile is forced into contact with rifling 3. The contact is accomplished by the external surface of the sabot being in contact with rifling 3. The sabot is nonrotatably connected with slug 5 so that the rotary motion which is imparted to the sabot by rifling 3 in the gun barrel is transmitted to the slug. When the projectile exits the discharge end of the gun barrel, the slug and the sabot are both rotating at the same number of revolutions per minute.

As shown in FIGS. 2–6 of the drawings, slug 5 has a forward end portion 20, a rear end portion 21 and an intermediate portion 25 formed with a waist 26 having a decreased diameter. The slug is generally cylindrical in lateral cross section and forward end portion 20 is formed with a taper 22 and a tapered axial blind bore 24. The slug tapers inwardly from forward end portion 20 to waist 26 and tapers outwardly from waist 26 to rear end portion 21. An enlarged entrance opening 28 connects with the open end of a blind bore 23 by an inward chamfer 29. A pair of outwardly extending radial lugs 30 are located on forward end portion 20 of slug 5 and a second pair of outwardly extending radial lugs 31 are located on rear end portion 21 of slug 5. The lugs on the forward end portion and the lugs on the rear end portion are radially spaced by 180° and all four lugs are located in the same longitudinal plane through the slug. Each lug 30 and 31 fits within a notch formed in a sabot segment as explained hereinafter to nonrotatably connect the sabot segment to the slug during travel along a gun barrel.

The wad 6 has an axial post 40 which fits into axial blind bore 23 which extends through rear end portion 21 of slug 5 into forward end portion 20 as shown in FIG. 2 of the drawings to firmly connect the wad to the slug. The wad has a trailing portion 41 connected to post 40 and located behind the rear end of slug 5. The trailing portion functions in the same manner as the feathers on an arrow in that it provides guidance to the slug as the slug travels from the gun barrel to a target. Additionally, the wad provides for a relatively level flight trajectory of the slug after it exits the discharge end of a gun barrel.

Figure 9:
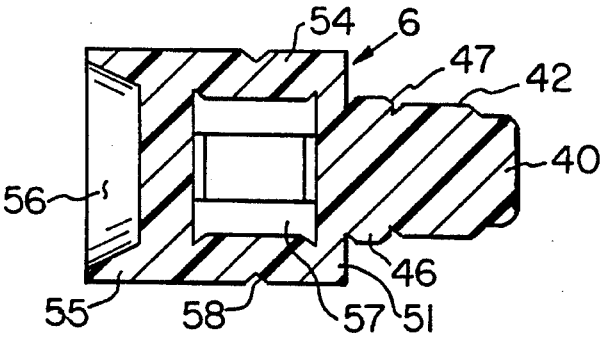
FIG. 9 is a longitudinal section on line IX—IX of FIG. 7.
Figure 11:
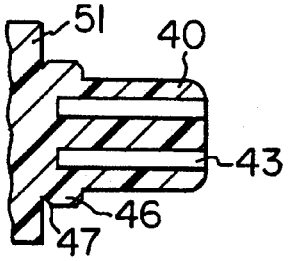
FIG. 11 is a section on line XI—XI of FIG. 10.
Figure 10:
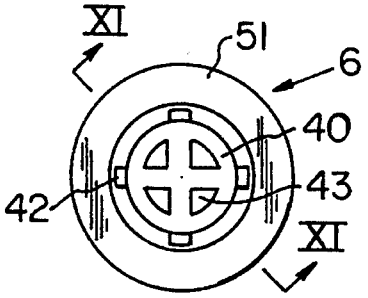
FIG. 10 is a front end view of a second embodiment of a wad.
Figure 12:
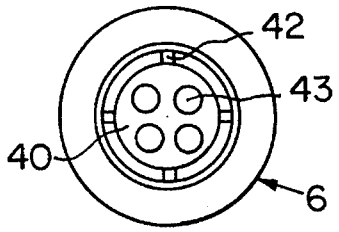
FIG. 12 is a front end view of a third embodiment of a wad.

With specific reference to FIGS. 7–11 of the drawings, it will be seen that post 40 of wad 6 has outwardly extending radial longitudinal ribs 42 radially spaced at 90° therearound to hold the post tightly in blind bore 23 of the slug. Post 40 is formed with a plurality of spaced longitudinal passages 43 which are parallel to the longitudinal axis of the post and extend from the distal end of the post to the juncture of the post with trailing portion 41. The passages in post 40 provide for a certain amount of compressibility of the post when it is forced into blind bore 23 in slug 5. As shown in FIGS. 10 and 12 of the drawings, the passages may have different cross section shapes.

The wad post has an annular portion 46 with forward and rear chamfered annular edges 47 located adjacent to trailing portion 41. Annular portion 46 of post 40 fits within the enlarged entrance opening 28 of blind bore 23 in slug 5. The ring formed by the rear chamfered annular edge 47 of annular portion 46 receives an annular bead of lead from slug 5 when the projectile is fired. The lead is forced into the ring at the rear of annular portion 46 by the physical forces generated by the explosion of powder charge 11 in shell casing 10. The annular bead of lead holds the wad firmly on the slug.

Figure 7:
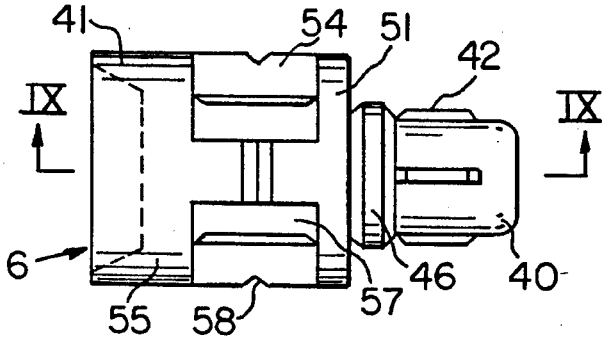
FIG. 7 is an elevation view of a trailing wad.
Figure 8:
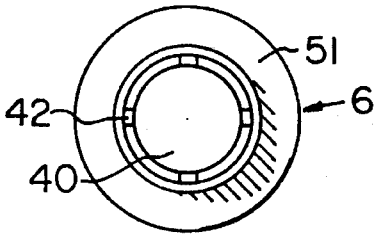
FIG. 8 is a front end view of the wad shown in FIG. 7.

Trailing portion 41 of wad 6 is shown in FIGS. 7 and 9 of the drawings. The trailing portion has a forward cylinder 51 integral with post 40 adjacent rear chamfered annular edge 47 of annular portion 46. A plurality of longitudinal radially spaced webs 54 extend rearwardly from cylinder 51 and the rear ends of webs 54 are integral with a disc 55 having an axial indentation 56. The webs 54 are radially spaced to provide openings 57 therebetween and each web is formed with a radial groove 58 approximately midway between the forward end and the rear end. Explosion of powder charge 11 in shell casing 10 compresses the webs into the position shown in FIG. 3 of the drawings. The compression is possible because of the radial groove 58 in each web. The trailing portion of wad 6 imparts a relatively flat trajectory to the projectile as it travels to the target.

Figure 13:
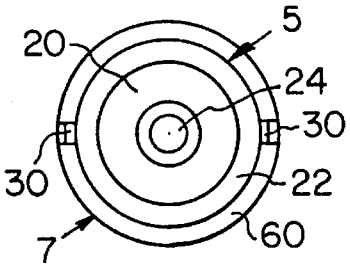
FIG. 13 is an end view of the slug shown in FIGS. 4–6 with a sabot.

FIG. 13 is a front view of the first embodiment of the projectile shown in FIGS. 1 and 2 of the drawings. The projectile has a lead slug 5 with a sabot 7 having a pair of arcuate segments 60 located thereon. Each longitudinal edge 62 of each sabot segment is formed with a notch 63 at the opposed ends. The notches 63 embrace lugs 30 and 31 on the forward and rear end portions of the slug when the sabot segments are in place on the exterior of slug 5 as shown in FIGS. 1 and 13 of the drawings. The opposed elongated longitudinal edges 62 of the sabot segments are in contact throughout the length of the sabot except at notches 63.

Figure 14:
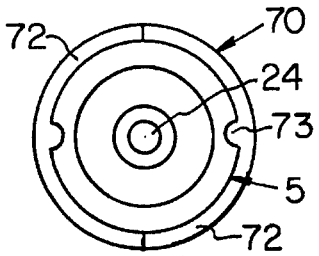
FIG. 14 is a front end view of a second embodiment of a slug with a sabot.
Figure 15:
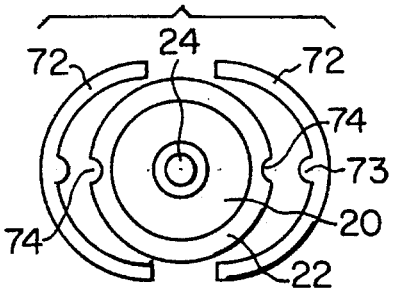
FIG. 15 is a front end view of the embodiment shown in FIG. 14 with the sabot segments separating from the slug.

A second embodiment of the invention is shown in FIGS. 14 and 15 of the drawings wherein a sabot 70 has segments 72 held on slug 5 by longitudinal inwardly directed radial tongues 73 which are formed on the ends of the inner surface of each segment. Each radial tongue 73 fits into an outwardly opening longitudinal radial groove 74 formed in the forward and rear end portions 20 and 21 of the slug. The grooves are radially spaced 180°. FIG. 15 of the drawings shows sabot segments 70 expanding away from slug 5 after discharge from a gun barrel.

Figure 17:
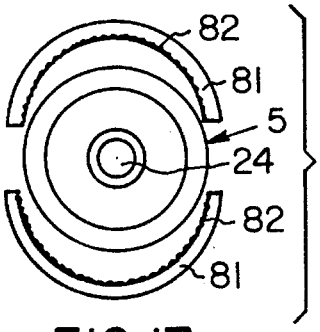
FIG. 17 is a front end view of the embodiment shown in FIG. 16 with the sabot segments separating from the slug.
Figure 16:
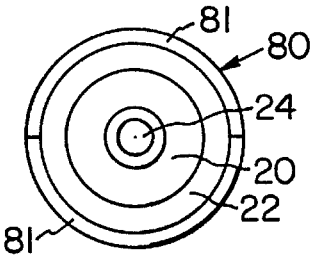
FIG. 16 is a front end view of a third embodiment of a slug with a sabot.

A third embodiment of the invention is shown in FIGS. 16 and 17 of the drawings wherein a sabot 80 has segments 81 which are formed with a serrated or roughened inner surface 82. The serrated inner surface can be confined to the ends of the inner surface of each sabot segment or, for ease of manufacture, can extend throughout the length of the inner surface of each sabot segment with the understanding that only the inner surfaces of the ends contact the forward and rear end portions 20 and 21 of lead slug 5. The serrations firmly grasp the outer surfaces of the forward and rear end portions of the slug to prevent rotation of the sabot segments relative to the slug during travel along the length of a rifled gun barrel.

Figure 18:
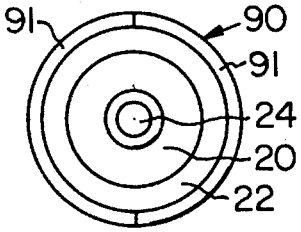
FIG. 18 is a front end view of a fourth embodiment of a slug with a sabot.
Figure 19:
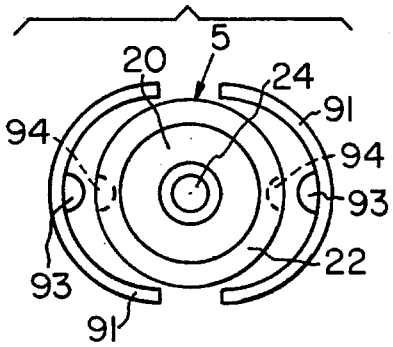
FIG. 19 is a front end view of the embodiment shown in FIG. 18 with the sabot segments separating from the slug.

The fourth embodiment of the invention shown in FIGS. 18 and 19 of the drawings includes a sabot 90 having segments 91. Each sabot segment has a radially inwardly extending hemispherical protrusion or button 93 at each end and the forward and rear end portions 20 and 21 of slug 5 have blind radial recesses 94. When the sabot segments are assembled on the slug, protrusions 93 extend into recesses 94 on the forward and rear end portions of the slug to prevent rotation of the sabot segments relative to the slug during travel along a rifled gun barrel.

Figure 21:
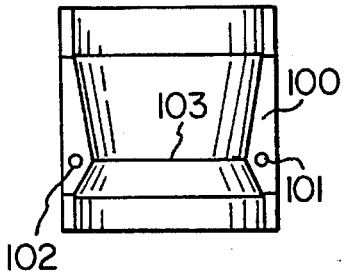
FIG. 21 is a plan view of the sabot segment shown in FIG. 20.
Figure 20:
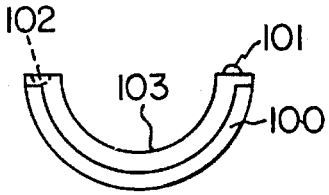
FIG. 20 is an end view of a sabot segment according to another embodiment of the invention.

FIGS. 20 and 21 of the drawings show a fifth embodiment of the invention wherein the sabot has a pair of segments 100. A longitudinal edge of each segment 100 is formed with a protrusion 101 or a blind hole 102 as shown in FIG. 20 of the drawings. The protrusion 101 on the longitudinal edge of one sabot segment fits into a complementary blind hole 102 on the longitudinal edge of the opposite sabot segment. Each segment 100 is formed with a radially inwardly extending convex neck 103 which cooperates with waist 26 on the exterior surface of slug 5 so that sabot segments 100 fit firmly on the slug.

It will be seen that in each embodiment of the invention the sabot segments are nonrotatably connected to the slug so that relative rotation between the sabot and the slug cannot take place. Because relative movement of the sabot and the slug is avoided, a relatively flat trajectory of the slug occurs as it travels from the gun barrel to a target.

The foregoing describes preferred embodiments of the invention and is given by way of example only. The invention is not limited to any of the specific features described herein, but includes all such variations thereof within the scope of the appended claims.

I claim:

1. A projectile comprising a substantially cylindrical metal slug having an exterior surface, a front end portion and a rear end portion and a sabot having a pair of independent arcuate segments, said sabot having an inner surface surrounding said exterior surface of said slug and an outer surface, a pair of radial outwardly extending lugs on said front end portion of said slug and a pair of radial outwardly extending lugs on said rear end portion of said slug, said radial outwardly extending lugs in each pair of lugs being radially spaced 180° from each other and all of said radial outwardly extending lugs located in the same longitudinal axial plane through said slug, each of said sabot segments having a pair of spaced longitudinal edges having opposed ends and a notch formed in each of said segments at each of said opposed ends of each of said longitudinal edges, wherein each of said radial outwardly extending lugs on said front end portion of said slug and said rear end portion of said slug extends into one of said notches whereby said radial outwardly extending lugs cooperate with said notches in said segments to provide a nonrotatable connection between said sabot and said slug when said projectile is propelled along a rifled gun barrel to impart a rotary motion to said sabot by contact between said outer surface of said sabot and rifling in a gun barrel and rotary motion is transferred from said sabot to said slug due to said nonrotatable connection between said sabot and said slug.

2. A projectile as set forth in claim 1 wherein said slug includes a blind axial hole formed in said front end portion and said rear end portion.

3. A projectile as set forth in claim 1 wherein said rear end portion of said slug has a rear surface and said slug includes a blind axial cavity formed in said rear end portion and extending into said front portion, said blind axial cavity having an enlarged diameter entry end opening formed at said rear surface of said rear end portion of said slug.

4. A projectile as set forth in claim 3 including a wad, said wad having an axial longitudinal post located within said blind axial cavity formed in said rear end portion of said slug and a trailing portion located adjacent said rear end portion of said slug, whereby said trailing portion of said wad stabilizes the trajectory of said projectile.

5. A projectile as set forth in claim 4 wherein said axial longitudinal post is formed with an outer annular portion, said outer annular portion having a radial inwardly chamfered edge adjacent said trailing portion of said wad to form an annular groove between said outer annular portion of said axial longitudinal post and said trailing portion of said wad, said annular groove located in said enlarged diameter entry end opening of said axial cavity of said rear surface of said rear end portion of said slug, whereby a metal bead fills said annular groove upon discharge of said projectile from a shell casing to firmly hold said wad to said slug.

6. A projectile as set forth in claim 4, wherein said axial longitudinal post is formed with a plurality of radially spaced longitudinal outwardly extending ribs to maintain said wad post firmly within said blind axial cavity in said rear end portion of said slug.

7. A projectile as set forth in claim 4 wherein said post is an elongated cylinder and a plurality of axially extending passages are formed in said post, whereby said post is radially compressible for insertion into said blind axial cavity in said slug.

8. A projectile as set forth in claim 1 wherein said slug includes an intermediate portion having a reduced diameter between said front end portion of said slug and said rear end portion of said slug.

9. A projectile as set forth in claim 1 including a wad attached to said slug.

10. A projectile as set forth in claim 9 wherein said wad includes a trailing portion located adjacent said rear end portion of said slug, whereby said trailing portion of said wad stabilizes the flight of said projectile.

11. A projectile as set forth in claim 10 wherein said trailing portion of said wad includes a cylindrical portion adjacent said rear end portion of said slug, a plurality of longitudinal substantially parallel spaced webs extending rearwardly from said cylindrical portion and a disc connected to the distal ends of said webs.

12. A projectile as set forth in claim 11 wherein said disc is formed with a rearwardly opening axial bore.

13. A projectile as set forth in claim 11 wherein each of said webs is formed with a radial groove located substantially midway between said cylindrical portion and said disc.

14. A projectile comprising a substantially cylindrical metal slug having an exterior surface, a front end portion and a rear end portion having an end and a sabot surrounding said slug, means for providing a nonrotatable connection between said sabot and said slug, a blind axial cavity formed in said rear end portion of said slug, said blind axial cavity having an enlarged diameter cylindrical entry end opening at said end of said rear end portion of said slug, and a wad having an axial longitudinal post located within said blind axial cavity in said rear end portion of said slug and a trailing portion located adjacent said end of said rear end portion of said slug and having a diameter larger than the diameter of said post, said post having an outer annular portion located in said enlarged diameter cylindrical entry end opening in said blind axial opening in said rear end portion of said slug, said outer annular portion having a radial inwardly and longitudinal rearwardly chamfered edge adjacent said trailing portion of said wad to form an annular groove between said outer annular portion of said post and said trailing portion of said wad, said annular groove located in said enlarged diameter cylindrical entry end opening of said blind axial cavity in said rear end portion of said slug, whereby a metal bead fills said annular groove upon discharge of said projectile from a shell casing to firmly connect said wad to said slug.

15. A projectile as set forth in claim 14 wherein said sabot is formed of arcuate segments surrounding said exterior surface of said slug, each of said segments has a roughened interior surface facing said exterior surface of said slug, wherein said means for providing a nonrotating connection between said sabot and said slug is contact between said roughened interior surface on each of said segments and said exterior surfaces of said front end portion of said slug and said rear end portion of said slug.

16. A projectile as set forth in claim 14 wherein said sabot is formed of arcuate segments surrounding said exterior surface of said slug, each of said arcuate segments having an interior surface and an elongated radial inwardly directed tongue formed on at least the ends of said interior surface of each of said segments, longitudinal radial grooves formed in said front end portion of said slug and in said rear end portion of said slug, said radial grooves in each of said front end portion of said slug and said rear end portion of said slug radially spaced 180° from each other to receive said elongated radial inwardly directed tongues on said interior surfaces of each of said segments, wherein said means for providing a nonrotatable connection between said sabot and said slug is said tongues located in said grooves.

17. A projectile as set forth in claim 14 wherein said sabot is formed of arcuate segments surrounding said exterior surface of said slug, each of said segments having an interior surface and at least one radial inwardly extending protrusion formed on said interior surface of each of said segments, at least one of said front end portion of said slug and said rear end portion of said slug having two blind recesses formed therein radially spaced 180° from each other to receive said radial inwardly extending protrusions on said segments, wherein said means for providing a nonrotatable connection between said sabot and said slug is said protrusions in said blind recesses.

18. A projectile as set forth in claim 14 wherein said sabot is formed of arcuate segments having an interior surface surrounding said exterior surface of said slug, each of said segments having spaced substantially parallel linear edges, one of said linear edges of each of said segments having an outwardly extending protrusion and the other of said linear edges of each of said segments having a blind hole formed therein, wherein said protrusion on one linear edge of one of said segments extends into said blind hole in the linear edge of the other of said segments and wherein said means for providing a connection between said sabot and said slug is a tight friction contact between said protrusion and said blind hole and said interior surface of said segments and said exterior surface of said slug.

19. A projectile as set forth in claim 18 wherein said slug is formed with a reduced diameter waist located between said front end portion and said rear end portion and each of said segments has an enlarged radius section intermediate the ends to fit tightly within said waist of said slug.

20. A projectile comprising a substantially cylindrical slug having a front end portion and a rear end portion and a sabot surrounding said slug, means for providing a nonrotatable connection between said sabot and said slug, a blind axial cavity formed in said rear end portion, and a wad having an axial longitudinal post located within said blind axial cavity in said rear end portion of said slug and a trailing portion located adjacent said rear end portion of said slug, and a plurality of axially extending passages formed in said axial longitudinal post, whereby said axial longitudinal post is radially compressible for insertion into said blind axial cavity in said rear end portion of said slug.

21. A projectile comprising a substantially cylindrical metal slug having an exterior surface, a front end portion and a rear end portion having an end surface and a sabot surrounding said slug, a blind axial cavity formed in said rear end portion of said slug, said blind axial cavity having an enlarged diameter cylindrical entry end opening at said end surface of said rear end portion of said slug, and a wad having an axial longitudinal post located within said blind axial cavity in said rear end portion of said slug and a trailing portion located adjacent said end surface of said rear end portion of said slug and having a diameter larger than the diameter of said post, said post being formed with an outer annular portion located in said enlarged diameter cylindrical entry end opening at said end surface of said rear end portion of said slug, said outer annular portion having a radial inwardly and longitudinal rearwardly chamfered edge adjacent said trailing portion of said wad to form an annular groove in said wad located between said outer annular portion of said axial longitudinal post and said trailing portion of said wad, said annular groove located in said enlarged diameter cylindrical entry end opening of said blind axial cavity in said rear end portion of said slug, whereby a metal bead fills said annular groove upon discharge of said projectile from a shell casing to firmly connect said wad to said slug.

22. A shell comprising a shell casing having a closed end and an open end, a powder charge within said shell casing adjacent said closed end of said shell casing, a substantially cylindrical metal slug located within said shell casing longitudinally spaced from said powder charge, said slug having an exterior surface, a front end portion and a rear end portion with an end facing said closed end of said shell casing and a sabot surrounding said slug located between said slug and said shell casing, a blind axial cavity formed in said rear end portion of said slug, said blind axial cavity having an enlarged diameter cylindrical entry end opening at said end of said rear end portion of said slug, and a wad having an axial longitudinal post located within said blind axial cavity in said rear end portion of said slug and a trailing portion-located adjacent said end of said rear end portion of said slug and having a diameter larger than the diameter of said post, said post being formed with an outer annular portion located in said enlarged diameter cylindrical entry end opening in said blind axial opening in said rear end portion of said slug, said outer annular portion having a radial inwardly and longitudinal rearwardly chamfered edge adjacent said trailing portion of said wad to form an annular groove between said outer annular portion of said post and said trailing portion of said wad, said annular groove located in said enlarged diameter cylindrical entry end opening of said blind axial cavity in said rear end portion of said slug, whereby a metal bead fills said annular groove upon discharge of said powder charge in said shell casing to firmly hold said post in said blind axial cavity in said rear end portion of said slug to connect said wad to said slug.

* * * * *

UNITED STATES PATENT AND TRADEMARK OFFICE

CERTIFICATE OF CORRECTION

PATENT NO. : 5,479,861

DATED : January 2, 1996

INVENTOR(S) : Anthony E. Kinchin

It is certified that error appears in the above-indentified patent and that said Letters Patent is hereby corrected as shown below:

Title page, Item: '[56] References Cited, U.S. PATENT DOCUMENTS', "4,413,565 11/1983 Mattey et al. ... 102/503" should read --4,413,565 11/1983 Matthey et al. ... 102/503--.

Title page, '[56] References Cited, U.S. PATENT DOCUMENTS', "4,505,204 3/1985 Wilkstrom ... 102/523" should read --4,505,204 3/1985 Wikström ... 102/523--.

Claim 3 Line 23 Column 6 after "front" insert --end--.

Claim 6 Line 43 Column 6 "4," should read --4--.

Claim 22 Line 1 Column 9 "portion-located" should read --portion located--.

Signed and Sealed this

Sixteenth Day of April, 1996

Bruce Lehman

*Attest:*

BRUCE LEHMAN

*Attesting Officer*

*Commissioner of Patents and Trademarks*